US005670847A

United States Patent [19]

Lin

[11] Patent Number: 5,670,847

[45] Date of Patent: Sep. 23, 1997

[54] SOCKET STRUCTURE WITH SLIDABLE INSULATIVE DISK FORMED IN LONGITUDINAL GROOVES FOR SHOCK HAZARD PROTECTION

[76] Inventor: Chiu-Yuan Lin, No. 150, Chang Hsin Street, Hsinchu City, Taiwan

[21] Appl. No.: 744,583

[22] Filed: Nov. 6, 1996

[51] Int. Cl.[6] ..... H05B 37/02

[52] U.S. Cl. ..... 315/185 S; 439/419; 439/667

[58] Field of Search ..... 315/185 S, 324; 439/242, 243, 244, 699.2, 661, 662, 665, 664, 666, 667, 660

[56] References Cited

U.S. PATENT DOCUMENTS

| | | | |
|---|---|---|---|
| 2,393,180 | 1/1946 | Merrill | 439/243 |
| 2,688,669 | 9/1954 | Quill | 439/667 |
| 2,747,168 | 5/1956 | Arena | 439/667 |
| 3,644,867 | 2/1972 | Krause | 439/666 |
| 5,385,485 | 1/1995 | Fu | 439/667 |
| 5,562,481 | 10/1996 | Myson | 439/419 |

FOREIGN PATENT DOCUMENTS

| | | | |
|---|---|---|---|
| 412939 | 7/1934 | United Kingdom | 439/419 |

*Primary Examiner*—Robert Pascal
*Assistant Examiner*—Michael Shingleton
*Attorney, Agent, or Firm*—Varndell Legal Group

[57] ABSTRACT

A Christmas tree light system including an electrical receptacle connected to power supply, and electrical wire having an electrical plug at one end connected to the electrical receptacle, and a plurality of lamp sockets respectively connected to the electrical wire to hold a respective bulb, wherein each lamp socket has an insulative plate supported on a spring member and forced upwards by it to disconnect a metal connecting plate from the center metal contact plate, which is adapted for contacting the tip contact of the bulb; the electrical plug has a cartridge fuse for overload protection, and protective means for shielding the conducting blades of the cartridge fuse; the electrical receptacle has movable stop means forced by spring means to block the way between the blade insertion slots and the electrical terminals.

5 Claims, 8 Drawing Sheets

SOCKET STRUCTURE WITH SLIDABLE INSULATIVE DISK FORMED IN LONGITUDINAL GROOVES FOR SHOCK HAZARD PROTECTION

BACKGROUND AND SUMMARY OF THE INVENTION

The present invention relates to Christmas tree light systems, and more particularly to such a Christmas tree light system that has overload protection, and means to protect the lamp socket and the electrical receptacle against electric shock when the bulb or the electrical plug is not installed.

Regular lamp sockets for Christmas tree light system commonly have two metal contact plates adapted for contacting the ring contact and tip contact of the bulb. However, when the bulb is not installed, the metal contact plates may be simultaneously touched, causing an electric shock. When an electrical receptacle for Christmas tree light system is not mounted with an electrical plug, the terminals are disposed in the blade insertion slots inside the housing, therefore they can be easily touched with a metal object by a child, causing an electric shock. Furthermore, regular electrical plugs may be equipped with a cartridge fuse for overload protection. These electrical plugs commonly have a fuse holder for holding a cartridge fuse, and a sliding cover for covering the fuse holder. However, when the sliding cover is opened, the conducting blades of the cartridge fuse are exposed to the outside. Therefore, the conducting blades of the cartridge fuse may be simultaneously touched when the sliding cover is opened.

The present invention has been accomplished to provide a Christmas tree light system which eliminates the aforesaid problems. According to one aspect of the present invention, the lamp socket has an insulative plate supported on a spring member and forced upwards by it to disconnect a metal connecting plate from the center metal contact plate, which is adapted for contacting the top contact of the bulb, therefore the center metal contact plate is prohibited from touch when the bulb is removed from the lamp socket. According to another aspect of the present invention, the fuse holder of the electrical plug has a protective flange for protecting the rear conducting blade of the cartridge fuse from touch; the sliding cover plate which covers the fuse holder protects the front conducting blade of the cartridge fuse when it is extended out of the fuse holder. According to still another aspect of the present invention, the electrical receptacle has movable stop means forced by spring means to block the way between the blade insertion slots and the electrical terminals.

DETAILED DESCRIPTION OF THE PREFERRED EMBODIMENT

Figure 1:
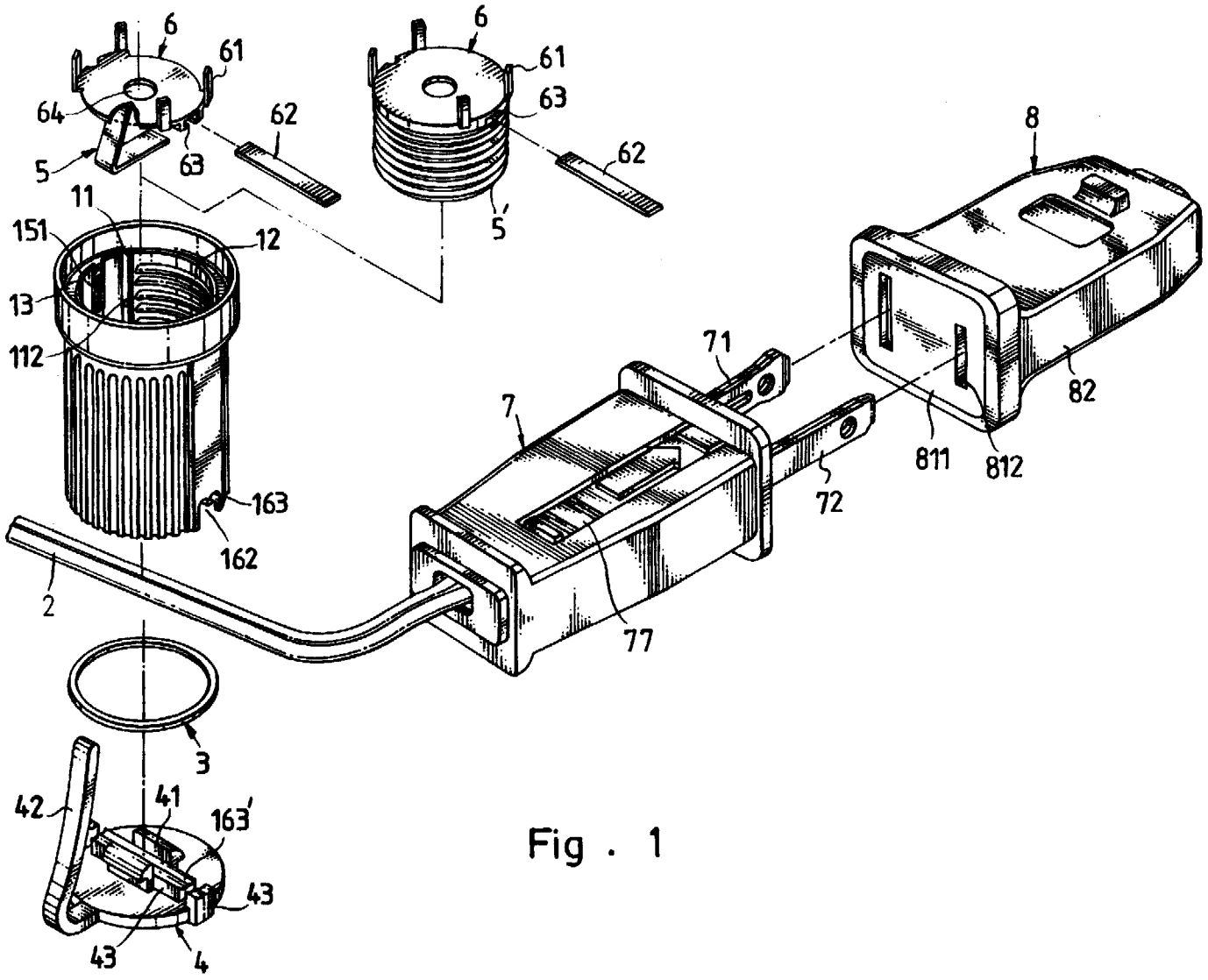
FIG.1 is an exploded view of a lamp socket according to the present invention.
Figure 2:
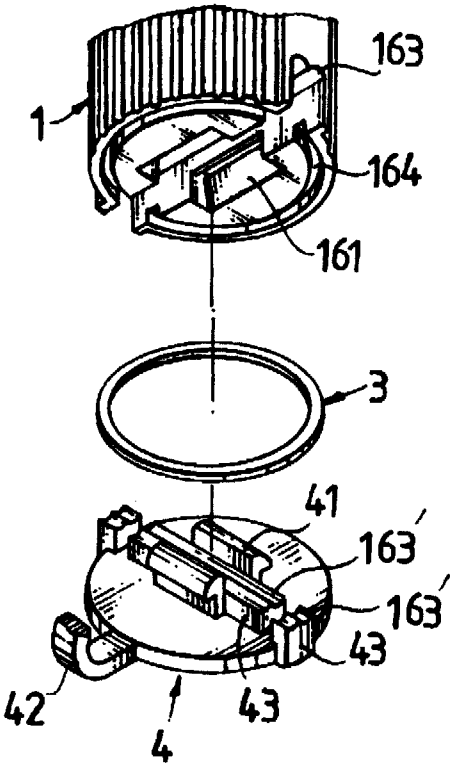
FIG. 2 shows the bottom structure of the socket body and the top structure of the socket cap according to the present invention.

Referring to FIGS. from 1 to 6, a lamp socket for a Christmas free light system in accordance with the present invention is connected to an electrical wire 2, comprised of a socket body 1, a rubber ring 3, a socket cap 4, a spring member 5 or 5', a circular insulative plate 6, a gasket ring 14, a first metal contact plate 15, a second metal contact plate 15', and a metal connecting plate 62.

Figure 4:
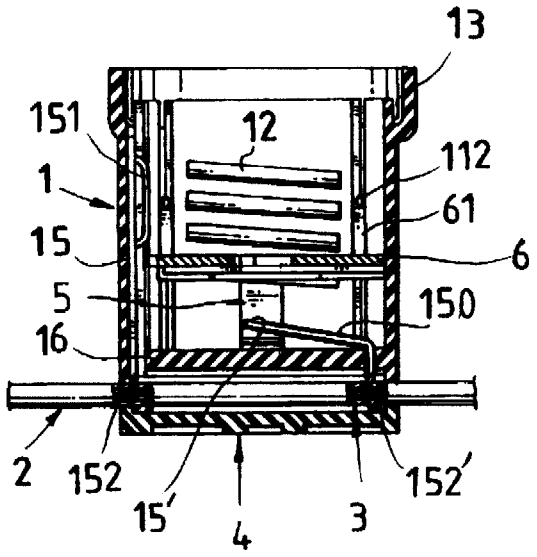
FIG. 4 is a sectional view taken along line 4—4 of FIG. 3.
Figure 3:
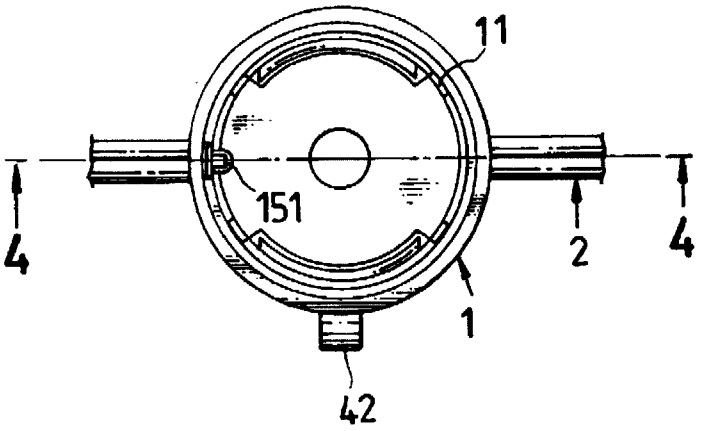
FIG. 3 is a top plain view of the lamp socket according to the present invention, showing the lamp socket fastened to the electrical wire.
Figure 5:
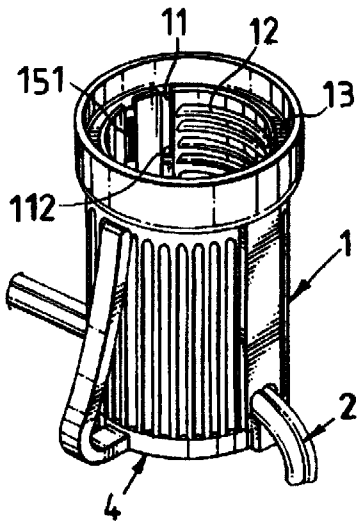
FIG. 5 is an elevational view of the lamp socket according to the present invention.
Figure 6:
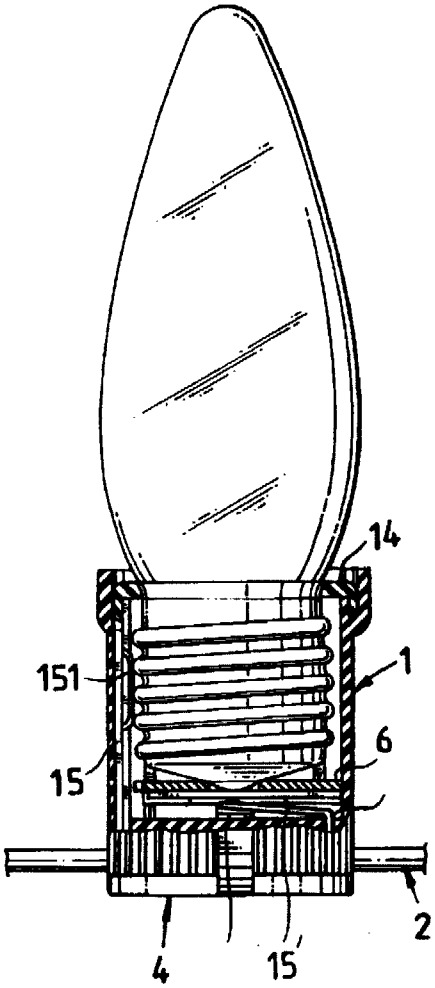
FIG. 6 is similar to FIG. 4 but showing the bulb installed.

The socket body 1 is a hollow, cylindrical, cup-like shell, comprising threads 12 around the inside wall, a plurality of longitudinal sliding grooves 11 equiangularly spaced around the inside wall and intersecting the threads 12, a plurality of transverse stop ribs 112 respectively disposed in the longitudinal sliding grooves 11 in the middle, an annular step 13 around the inside wall thereof at the top which receives the gasket ring 14, a bottom wall 16, a circular bottom chamber 164, a transverse wire groove 163 at the bottom of the bottom wall 16 in communication with the circular bottom chamber 164, and two retaining notches 161 disposed at the bottom of the bottom wall 16 within the circular bottom chamber 164 and separated by the transverse wire groove 163. The first metal contact plate 15 comprises an elongated contact body 151 mounted in a longitudinal contact plate mounting groove (not shown) in the inside wall of the socket body 1 and adapted for contacting the ring contact of the bulb, and a pointed tip 152 partially projecting into the transverse wire groove 163. The second metal contact 15' is mounted in a through hole (not shown) through the bottom wall 16 and suspended above the bottom wall 16 for contacting the tip contact of the bulb, having a pointed tip 152' partially projecting into the transverse wire groove 163. The electrical wire 2 is mounted in the transverse wire groove 163 of the socket body 1 and connected to an electrical plug 7. The rubber ring 3 is mounted within the circular bottom chamber 164 of the socket body 1. The socket cap 4 is fitted into the circular bottom chamber 164 of the socket body 1 to hold down the rubber ring 3 and the electrical wire 2. When the socket cap 4 is installed, the electrical wire 2 is forced against the pointed tip 152 of the first metal contact plate 15 and the pointed tip 152' of the second metal contact plate 15', thereby causing the pointed tips 152, 152' to cut into the insulator of the electrical wire 2 and to make a electrical contact with a respective conductor therein. The second metal contact plate 15' is preferably sleeved with an insulative jacket 150, with its two opposite ends extended out of the insulative jacket 150 for making contact respectively. The socket cap 4 comprises a plurality of upright press blocks 43 raised from the inside wall and arranged in line and adapted for fitting into the transverse wire groove 163 of the socket body 1 to hold down the electrical wire 2 and the rubber ring 3, two upright hooks 41 respectively raised from the inside wall and separated by the upright press blocks 43 and adapted for hooking in the retaining notches 161 of the socket body 1, and a clip 42 raised from the periphery for fastening. The press blocks 43 have a respective curved top edge 163' fitting the curvature of the cross section of the transverse wire groove 163. The spring member 5 or 5' is mounted inside the socket body 1 above the bottom wall 16 to impart an upward pressure to the circular insulative plate 6. The circular insulative plate 6 is mounted inside the socket body 1 and supported on the spring member 5, or 5', having a plurality of upright mounting legs 61 raised from the periphery and respectively forced into the longitudinal sliding grooves 11 and stopped below the transverse stop ribs 112, a center through hole 64 adapted for receiving the tip contact of the bulb, and a bottom channel 163. The metal connecting plate 62 is mounted in the bottom channel 163 and covered over the center through hole 64 at the bottom for contacting the tip contact of the bulb. When the bulb is threaded into the socket body 1 and screwed up with the threads 12 and the elongated contact body 151 of the first metal contact plate 15, the circular insulative plate 6 is lowered to compress the spring member 5 or 5' and to force the metal connecting plate 62 into contact with the second metal contact plate 15', and the tip contcact of the bulb is disposed in contact with the metal connecting plate 62, and therefore the bulb is electrically connected to the electrical wire (see FIG. 5). When the bulb is removed from the socket body 1, the spring member 5 or 5' immediately pushes the circular insulative plate 6 upwards, thereby causing the metal connecting plate 62 to be disconnected from the second metal contact plate 15' (see FIG. 4).

Figure 8:
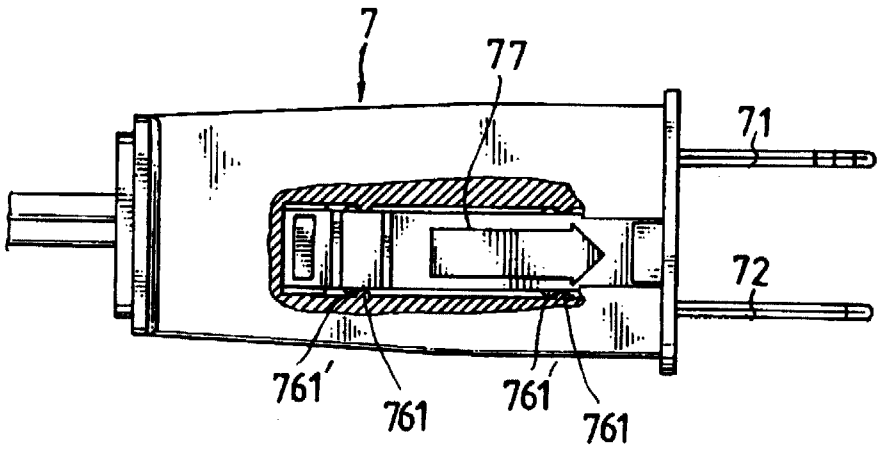
FIG. 8 is a sectional view of the electrical plug shown in FIG. 7.
Figure 7:
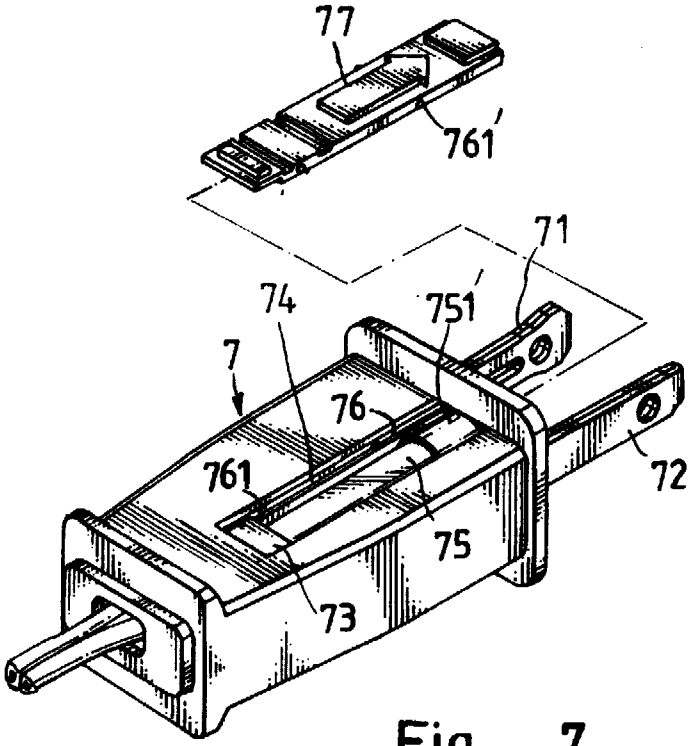
FIG. 7 is an elevational view of an electrical plug according to the present invention, showing the sliding cover plate removed from the longitudinal sliding groove.
Figure 9:
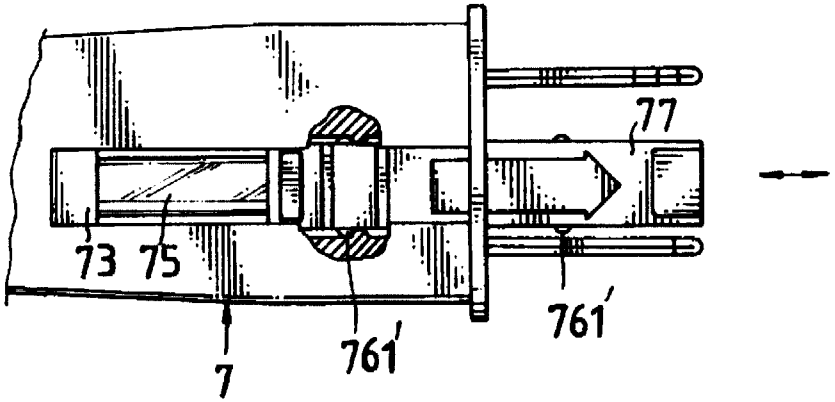
FIG. 9 is similar to FIG. 8 but showing the sliding cover plate extended out of the longitudinal sliding groove.

Referring to FIGS. 7 to 9 and FIG. 1 again, the electrical plug 7 comprises a negative metal contact blade 71 and a positive metal contact blade 72 respectively extended out of the front side, a fuse holder 74 on the inside, a cartridge fuse 75 mounted in the fuse holder 74 and connected between the positive metal contact blade 72 and the corresponding conductor of the electrical wire 2, a longitudinal sliding groove 76 above the fuse holder 74, two symmetrical pairs of raised portions 761 bilaterally projecting into the longitudinal sliding groove 76 near two opposite ends, and a sliding cover plate 77 slidably mounted in the longitudinal sliding groove 76 to close the fuse holder 74. The sliding cover plate 77 has two symmetrical pairs of raised portions 761' raised from two opposite lateral sides thereof near two opposite ends, and forced into engagement with the raised portions 761 in longitudinal sliding groove 76. When the cartridge fuse 75 is loaded in the fuse holder 74, the rear conducting blade (not shown) of the cartridge fuse 75 is covered within a protective flange 73 at one end of the fuse holder 74. When the sliding cover plate 77 is moved outwards to open the fuse holder 74, the front pair of raised portions 761 in the longitudinal sliding groove 76 are still engaged with the rear pair of raised portions 761' of the sliding cover plate 77, and the rear end of the sliding cover plate 77 is maintained covered over the front conducting blade 751' of the cartridge fuse 75 (see FIG. 9).

Figure 11:
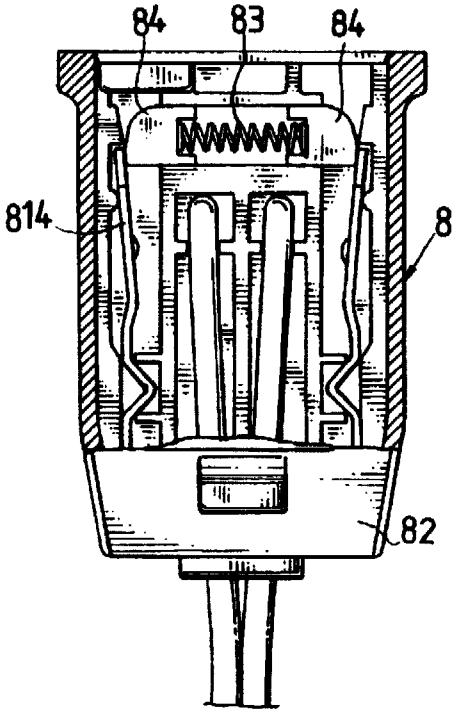
FIG. 11 is a sectional assembly view of the electrical receptacle shown in FIG. 10.
Figure 10:
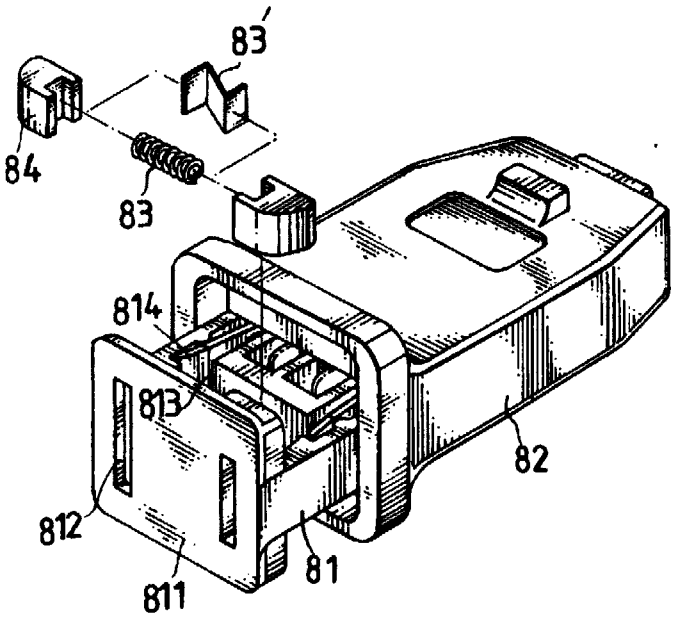
FIG. 10 is an exploded view of an electrical receptacle according to the present invention.

Referring to FIGS. 10 and 11, the electrical receptacle, referenced by 8, comprises an insulative base 81 having a vertical stop wall 811 at one end and a transverse chamber 813 adjacent to the vertical stop wall 811, two terminals 814 longitudinally and bilaterally mounted in the base 81 and partially projecting into the transverse chamber 813, two substantially arched stop blocks 83 mounted in the transverse chamber 813, and a spring which can be a compression spring 83 or a curved spring plate 83' mounted in the transverse chamber 813 and connected between the stop blocks 84, and an insulative cover shell 82 covered around the base 81. The vertical stop wall 811 has two blade insertion slots 812 adapted for receiving the metal contact blades 71, 72 of the aforesaid electrical plug 7. The spring 83 or 83' imparts a pressure to the stop blocks 84 reversed directions, causing the stop blocks 84 to separate the terminals 814 from the slots 812 of the vertical stop wall 811.

Figure 12:
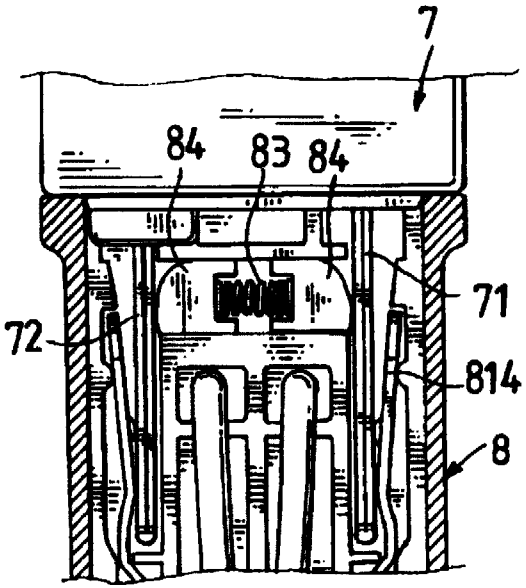
FIG. 12 is another sectional view of the electrical receptacle according to the present invention, showing the electrical plug connected.

Referring to FIG. 12, when the metal contact blades 71, 72 of the electrical plug 7 are respectively inserted into the slots 812 of the vertical stop wall 811, the stop blocks 84 are forced inwards toward each other to compress the spring 83 or 83', and therefore the metal contact blades 71, 72 are allowed to be forced forwards into contact with the terminals 814 respectively.

Figure 13:
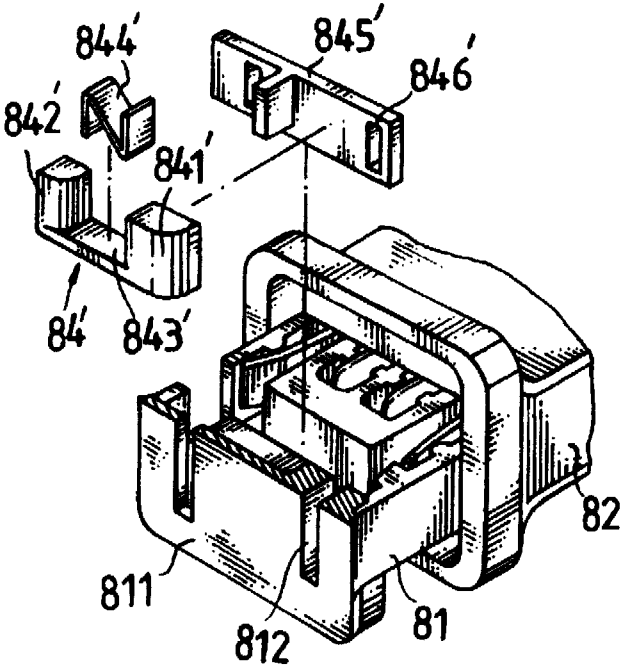
FIG. 13 is an exploded view of an alternate form of the electrical receptacle according to the present invention.
Figure 14:
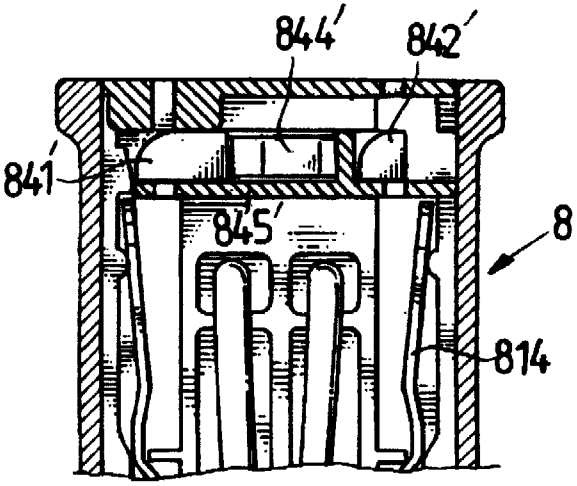
FIG. 14 is a sectional assembly view of the electrical receptacle shown in FIG. 13.
Figure 15:
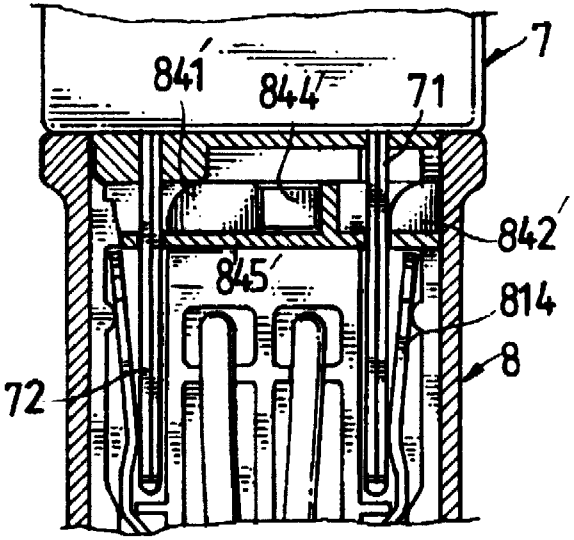
FIG. 15 is similar to FIG. 14 but showing the electrical plug connected.

FIGS. 13, 14, and 15 show an alternate form of the electrical receptacle 8. According to this alternate form, the electrical receptacle 8 comprises a base 81 having a vertical stop wall 811 and two blade insertion slots 812 in the vertical stop wall 811, a substantially T-shaped partition plate 845' fixedly mounted in the base 81 and having two through holes 846' respectively aligned between the slots 812 of the vertical stop wall 811 and the terminals 814, a substantially U-shaped movable stop member 84' mounted in the base 81 between the vertical stop wall 811 and the T-shaped partition plate 845' and having a flat bottom wall 843' and two upright blocks 841', 842' raised from the flat bottom wall 843', and a spring 844' stopped between a part of the T-shaped partition plate 845' and one upright block 841'. The upright blocks 841', 842, of the movable stop member 84' are forced by the spring force of the spring 844' into the way between the slots 812 of the vertical stop wall 811 and the through holes 846' of the partition plate 845' (see FIG. 14). When the metal contact blades 71, 72 of the electrical plug 7 are respectively inserted into the slots 812 of the vertical stop wall 811, the movable stop member 84' is forced sideways to compress the spring 844', and therefore the metal contact blades 71, 72 are allowed to be forced forwards through the through holes 846' of the movable stop member 84' into contact with the terminals 814 respectively.

I claim:

1. A Christmas tree light system comprising an electrical receptacle connected to power supply, and electrical wire having an electrical plug at one end connected to said electrical receptacle, and a plurality of lamp sockets respectively connected to said electrical wire to hold a respective bulb, wherein:

each of said electrical sockets comprises a hollow, cylindrical, cup-like shell socket body, a rubber ring, a socket cap, a spring member, a circular insulative plate, a gasket ring, a first metal contact plate, a second metal contact plate, and a metal connecting plate, said socket body comprising a plurality of threads on the inside adapted for receiving a bulb, a plurality of longitudinal sliding grooves equiangularly spaced on the inside and intersecting said threads, a plurality of transverse stop ribs respectively disposed in said longitudinal sliding grooves in the middle, an annular step on the inside above said threads and adapted for receiving said gasket ring, a bottom wall, a through hole through said bottom wall, a circular bottom chamber, a transverse wire groove on said bottom wall in communication with said circular bottom chamber for receiving said electrical wire, and two retaining notches disposed in said bottom wall within said circular bottom chamber and separated by said transverse wire groove, said first metal contact plate having an elongated contact body longitudinally mounted inside said socket body and adapted for contacting the ring contact of the corresponding bulb, and a pointed tip partially projecting into said transverse wire groove, said second metal contact plate being mounted in the through hole through said bottom wall and suspended above said bottom wall for contacting the tip contact of the corresponding bulb and having a pointed tip partially projecting into said transverse wire groove, said rubber ring being mounted within the circular bottom chamber of said socket body, said socket cap being fitted into the circular bottom chamber of said socket body to hold down said rubber ring and said electrical wire, permitting the pointed tips of said first metal contact plate and said second metal contact plate to be respectively forced to cut into said electrical wire and to make contact with a respective conductor in said electrical wire, said socket cap comprising a plurality of upright press blocks fitted into said transverse wire groove of said socket body and pressed on said electrical wire and said rubber ring, two upright hooks respectively hooked in the retaining notches of said socket body, and a clip raised from the periphery of fastening, said circular insulative plate being mounted inside said socket body and supported on said spring member above the bottom wall of said socket body, having a plurality of upright mounting legs raised from the periphery and respectively forced into the longitudinal sliding grooves of said socket body and stopped below the transverse stop ribs of said socket body, a center through hole adapted for receiving the tip contact of the corresponding bulb, and a bottom channel adapted for receiving said metal connecting plate, said metal connecting plate being mounted in the bottom channel of said circular insulative plate and covered over the center through hole of said circular insulative plate for contacting the tip contact of the corresponding bulb, said circular insulative plate being lowered to compress said spring member and to force said metal connecting plate into contact with said second metal contact plate when the corresponding bulb is threaded into said socket body;

said electrical plug comprises a positive metal contact blade and a negative metal contact plate respectively extended out of a front side thereof, a fuse holder on the inside, a cartridge fuse loaded in said fuse holder and connected between said positive metal contact blade and one conductor of said electrical wire, a longitudinal sliding groove above said fuse holder, two symmetrical pairs of raised portions bilaterally projecting into said longitudinal sliding groove near two opposite ends, and a sliding cover plate slidably mounted in said longitudinal sliding groove to close said fuse holder and having two symmetrical pairs of raised portions at two opposite lateral sides respectively forced into engagement with the raised portions in said longitudinal sliding groove, said fuse holder having a protective flange at one end adapted for protecting one conducting blade of said cartridge fuse.

2. The Christmas tree light system of claim 1 wherein said spring member is compression spring.

3. The Christmas tree light system of claim 1 wherein said spring member is a curved spring plate.

4. The Christmas tree light system of claim 1 wherein said electrical receptacle comprises an insulative base having a vertical stop wall at one end and two blade insertion slots in said vertical stop wall and a transverse chamber adjacent to said vertical stop wall, two terminals longitudinally and bilaterally mounted in said base and partially projecting into said transverse chamber, two substantially arched stop blocks mounted in said transverse chamber, and a spring member mounted in said transverse chamber and connected between said stop blocks, and an insulative cover shell covered around said base, said two stop blocks being forced outwards in reversed directions by the spring member of said electrical receptacle to separate said terminals from said blade insertion slots, said stop blocks being forced inwards toward each other against the spring member of said electrical receptacle for permitting the metal contact blades of said electrical plug to be forced into contact with said terminals when the metal contact blades of said electrical plug are respectively inserted into said blade insertion slots of said electrical receptacle.

5. The Christmas tree light system of claim 1 wherein said electrical receptacle comprises a base having a vertical stop wall and two blade insertion slots in said vertical stop wall, a substantially T-shaped partition plate fixedly mounted in said base and having two through holes respectively aligned between said blade insertion slots and said terminals, a substantially U-shaped movable stop member mounted in said base between said vertical stop wall and said T-shaped partition plate and having two upright blocks at two opposite ends, and a spring stopped between a part of said T-shaped partition plate and one upright blocks of said movable stop member, the upright blocks of said movable stop member being forced by the spring force of the spring of said electrical receptacle into the way between said blade insertion slots and the through holes of said partition plate, said movable stop member being forced sideways to compriess the spring of said electrical receptacle when the metal contact plates of said electrical plug are respectively inserted into said blade insertion slots, for permitting the metal contact blades of said electrical receptacle to be forced forwards through the through holes of said movable stop member into contact with said terminals respectively.

* * * * *